US008783515B2

(12) United States Patent
Branyon et al.

(10) Patent No.: US 8,783,515 B2
(45) Date of Patent: Jul. 22, 2014

(54) DISPENSER WITH FITMENT

(71) Applicant: Sonoco Development, Inc., Hartsville, SC (US)

(72) Inventors: Jacob D. P. Branyon, Hartsville, SC (US); Scott William Huffer, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 13/660,432

(22) Filed: Oct. 25, 2012

(65) Prior Publication Data

US 2014/0117056 A1 May 1, 2014

(51) Int. Cl.
*B65D 35/00* (2006.01)

(52) U.S. Cl.
CPC ..... *B65D 35/00* (2013.01)
USPC ..... 222/107; 222/566; 222/567; 222/568; 220/679; 220/680; 220/678; 215/44

(58) Field of Classification Search
USPC ..... 222/107, 568, 567, 566; 220/694, 890, 220/679, 680, 678, 288, 717; 215/44; 411/904; 493/51, 269, 386, 297
See application file for complete search history.

(56) References Cited

U.S. PATENT DOCUMENTS

| | | | | | |
|---|---|---|---|---|---|
| 493,616 | A | * | 3/1893 | Clark | 222/107 |
| 548,890 | A | * | 10/1895 | Scales | 222/107 |
| 560,984 | A | * | 5/1896 | Funk | 222/215 |
| 570,728 | A | | 11/1896 | Goodwin | |
| 621,573 | A | * | 3/1899 | Kinne | 222/107 |
| 666,443 | A | * | 1/1901 | Smith | 222/107 |
| 706,541 | A | | 8/1902 | Feval | |
| 722,508 | A | * | 3/1903 | Horn | 222/107 |
| 722,811 | A | | 3/1903 | Paine | |
| 1,269,103 | A | | 6/1918 | Lobl | |
| 1,481,339 | A | | 1/1924 | Barron | |
| 1,709,411 | A | | 4/1929 | Simmons | |
| 1,869,594 | A | | 8/1930 | Johnston | |
| 1,817,732 | A | | 8/1931 | Boruss | |
| 1,980,566 | A | | 8/1931 | Wright | |
| 2,002,718 | A | * | 5/1935 | Roselle | 222/107 |
| 2,038,760 | A | * | 4/1936 | Roselle | 222/107 |

(Continued)

FOREIGN PATENT DOCUMENTS

| | | | |
|---|---|---|---|
| DE | 8714622.3 | U1 | 2/1988 |
| EP | 0611 356 | B1 | 4/1996 |
| EP | 1 882 637 | A1 | 1/2008 |
| WO | WO 2006/082473 | A2 | 8/2006 |

*Primary Examiner* — Kevin P Shaver
*Assistant Examiner* — Michael J Melaragno
(74) *Attorney, Agent, or Firm* — Flaster/Greenberg, P.C.

(57) ABSTRACT

A dispenser for storing and dispensing product and a method of assembly is defined. The dispenser includes a tubular body having an open first end and an opposing second end. The body is formed by a sidewall surrounding a longitudinal axis and defining an internal volume. The sidewall includes an inside wall surface and a side seam sealing the sidewall. A fitment attachment member is formed separately from the body and is secured to the inside surface of the sidewall, adjacent the open end of the body. The attachment member has a linear dimension, with linear end portions of the member positioned adjacent one another in forming a ring within the tubular body. A fitment is provided having a fitment retainer pattern formed thereon. A corresponding retainer pattern is formed on the attachment member, with the retainer patterns cooperating for securing the fitment to the body.

27 Claims, 4 Drawing Sheets

(56) References Cited

U.S. PATENT DOCUMENTS

| | | | | | |
|---|---|---|---|---|---|
| 2,129,839 | A | | 9/1938 | Henderson | |
| 2,134,910 | A | | 11/1938 | Dvorak | |
| 2,252,854 | A | | 8/1941 | Hubner | |
| 2,269,661 | A | | 1/1942 | Gurwick | |
| 2,274,258 | A | | 2/1942 | Roselle | |
| 2,347,737 | A | | 5/1944 | Fuller | |
| 2,377,532 | A | | 6/1945 | Waters | |
| 2,383,230 | A | * | 8/1945 | Voke | 156/69 |
| 2,415,906 | A | * | 2/1947 | Paige | 222/107 |
| 2,430,046 | A | * | 11/1947 | Dreyfus | 222/107 |
| 2,441,649 | A | | 5/1948 | Sprague | |
| 2,452,607 | A | | 11/1948 | Slaughter | |
| 2,484,965 | A | | 10/1949 | Slaughter | |
| 2,542,294 | A | | 2/1951 | Smith | |
| 2,575,138 | A | | 11/1951 | Slaughter | |
| 2,584,632 | A | | 2/1952 | Southwick, Jr. | |
| 2,682,974 | A | | 7/1954 | Smith | |
| 2,686,616 | A | * | 8/1954 | Barlow | 222/107 |
| 2,704,100 | A | | 3/1955 | Freeman | |
| RE25,313 | E | | 1/1963 | Walker | |
| 3,074,837 | A | | 1/1963 | Flax | |
| 3,128,215 | A | * | 4/1964 | Hood et al. | 156/69 |
| 3,198,375 | A | | 8/1965 | Hunter | |
| 3,244,576 | A | | 4/1966 | Swartz | |
| 3,355,340 | A | | 11/1967 | Calvert et al. | |
| 3,434,906 | A | | 3/1969 | De Greeve et al. | |
| 3,438,116 | A | | 4/1969 | Stengle, Jr. | |
| 3,504,067 | A | | 3/1970 | Trecek | |
| 3,764,425 | A | * | 10/1973 | Neff | 156/69 |
| 3,778,321 | A | | 12/1973 | Abbott | |
| 3,788,509 | A | * | 1/1974 | Keeler | 215/324 |
| 3,823,850 | A | | 7/1974 | Holoubek et al. | |
| 3,874,558 | A | | 4/1975 | Rockefeller | |
| 3,894,381 | A | | 7/1975 | Christine et al. | |
| 3,948,704 | A | | 4/1976 | Evans | |
| 3,952,676 | A | | 4/1976 | Rockefeller | |
| 3,960,624 | A | | 6/1976 | Erlandson | |
| 4,006,275 | A | | 2/1977 | Monia | |
| 4,020,978 | A | | 5/1977 | Szczepanski | |
| 4,265,948 | A | | 5/1981 | Hayes et al. | |
| 4,384,440 | A | | 5/1983 | Ohlsson | |
| 4,493,439 | A | | 1/1985 | Ledewitz | |
| 4,512,136 | A | | 4/1985 | Christine | |
| 4,512,832 | A | | 4/1985 | Rausing | |
| 4,527,699 | A | * | 7/1985 | Namba et al. | 215/12.2 |
| 4,557,888 | A | | 12/1985 | Rausing et al. | |
| 4,603,536 | A | | 8/1986 | de la Poype | |
| 4,732,299 | A | | 3/1988 | Hoyt | |
| 4,767,478 | A | | 8/1988 | Christine | |
| 4,794,750 | A | | 1/1989 | Schmidt et al. | |
| 4,852,726 | A | * | 8/1989 | Lee | 206/1.9 |
| 4,852,793 | A | | 8/1989 | Homm et al. | |
| 5,186,358 | A | * | 2/1993 | McVay | 222/1 |
| 5,275,311 | A | | 1/1994 | Piarrat | |
| 5,606,844 | A | | 3/1997 | Takagaki et al. | |
| 5,690,764 | A | * | 11/1997 | Dirksing et al. | 156/69 |
| 5,730,694 | A | | 3/1998 | Hagleitner | |
| 6,092,933 | A | | 7/2000 | Treu | |
| 6,248,194 | B1 | * | 6/2001 | Kanner | 156/69 |
| 6,321,944 | B1 | | 11/2001 | Cetrangolo | |
| 6,626,296 | B1 | * | 9/2003 | Jimu et al. | 206/447 |
| 6,805,261 | B1 | | 10/2004 | Laudenberg | |
| 6,832,462 | B2 | | 12/2004 | Peacock et al. | |
| 6,981,614 | B2 | * | 1/2006 | Niggemyer | 222/107 |
| 7,322,918 | B2 | | 1/2008 | Matsumura et al. | |
| 8,096,448 | B2 | | 1/2012 | Keller et al. | |
| 2002/0027122 | A1 | | 3/2002 | Herrera | |
| 2003/0019561 | A1 | * | 1/2003 | Tominaga et al. | 156/73.1 |
| 2006/0163293 | A1 | * | 7/2006 | Peay | 222/611.1 |
| 2007/0095865 | A1 | * | 5/2007 | Chick | 222/568 |
| 2009/0065528 | A1 | | 3/2009 | Bray | |
| 2011/0027753 | A1 | * | 2/2011 | Maurat et al. | 433/141 |

* cited by examiner

DISPENSER WITH FITMENT

FIELD OF THE INVENTION

The present disclosure relates to a dispenser, preferably to a dispenser in the form of a flexible tube, having a fitment secured at one end.

BACKGROUND OF THE INVENTION

Dispensers for flowable product are known in many different forms. One form of dispenser may include a tubular body having a sealed end and a closure formed at the opposing end. There are many known forms for the closure within a tubular dispenser, with various known methods of forming and securing the closure at the end of the tube.

U.S. Pat. No. 2,383,230 to Vike shows a tubular package formed by rolled sheet of material that is heat sealed along overlapping edges of the sheet. A fitting is inserted into one end of the tube, with the inserted flange portion being sealed to the tube by a solvent material.

German patent publication G 8714622.3 shows a can-like container having a removable lid that forms a seal with the inside surface of the upper rim. In one figure, an internal thread is formed by a ring positioned on the inside surface of the rim.

U.S. Pat. No. 2,484,965 to Slaughter shows a tubular structure with a cap member fixed at one end. The tube is formed as an extrusion, with a cap inserted periodically into the extruded tube. The cap includes an external thread that is bonded to the softened inside surface of the tube.

EP 0611356 B1 to Benarrouch et al shows a tubular structure having an internal thread formed at one end of the tube. The internal threads appear to be formed at the same time as the tube by an injection molding process.

U.S. Pat. No. 6,321,944 to Cetrangolo shows a tube used as a package for various items, such as toiletries. In one form, a cap portion includes a circular base that is inserted into the open end of the tube.

SUMMARY OF THE INVENTION

In one aspect of the disclosure a dispenser is defined for storing and dispensing product. The dispenser includes a tubular body having an open first end. The body is formed by a sidewall surrounding a longitudinal axis and defining an internal volume. The sidewall includes an inside wall surface and a side seam sealing the sidewall. A fitment attachment member is formed separately from the body and is secured to the inside surface of the sidewall, adjacent the open end of the body. The attachment member has a linear dimension, with linear end portions of the member positioned adjacent one another in thrilling a ring within the tubular body. A fitment is provided having a fitment retainer pattern formed thereon. A corresponding retainer pattern is formed on the attachment member. The fitment retainer pattern and the corresponding retainer pattern on the ring cooperate with one another for securing the fitment to the body.

In another aspect of the dispenser, the body preferably extends longitudinally for a distance greater than a maximum transverse dimension of the interior volume. The side seam preferably extends in a longitudinal direction substantially aligned with the longitudinal axis of the sidewall. Further, the ring has a circular form, substantially concentric with the longitudinal axis. Preferably, the linear end portions of the member are secured in an abutting relationship.

In a further aspect of the dispenser, the retainer pattern on the body portion of the fitment is formed as an external screw thread. Further, the corresponding retainer pattern on the member is also formed as a screw thread, with the thread pattern facing radially inward on the formed ring.

In a further aspect of the dispenser, the member is secured to the inside surface of the sidewall by an ultrasonic weld. In a further aspect of the dispenser, the side seam on the sidewall of the tubular body is formed by an ultrasonic weld.

In a further aspect of the dispenser, an opposing second end of the tubular body is provided. The second end of the tube may be closed by a further attachment structure, such as a fitment, or may be sealed. In one aspect of the dispenser, the second end of the tubular body may be closed by flattening the sidewall with the inside surfaces adjacent the one another. The seal of the inside surfaces may further be formed by an ultrasonic weld.

In a further aspect of the disclosure, a method of assembling a dispenser is provided. The method includes the provision of a sheet having a first surface, a front edge and an elongated length. An elongated attachment member is provided and positioned adjacent the front edge of the sheet, transverse to the length of the sheet. The attachment member includes a retainer pattern formed thereon. The member is secured to the first surface of the sheet with the retainer pattern facing in the same direction as the first surface. The sheet and attachment member are rolled about a longitudinal axis to form a tubular body. The tubular body includes an inside surface formed from the first surface of the sheet and an internal ring is formed by the member and is position adjacent one end of the tubular body, with the retainer pattern inwardly facing on the ring. A fitment is provided having an external retainer pattern formed for mating with the inwardly facing retainer pattern formed by the ring and securing the fitment therein for closing the one end of the tubular body.

In a further aspect of the method the fitment includes a fitment body portion, a discharge opening formed in the body portion, and a fitment retainer portion formed on the body portion, with the fitment retainer porting having the retainer pattern thereon.

In a further aspect of the method, a second end of the tubular body, opposite of the end having the ring thereon, may be closed to define the internal storage volume. The second end may be closed by providing a further attachment structure, and an associated fitment, or may be sealed. In one aspect of the contemplated method, the second end of the tubular body may be closed by flattening the sidewall, with inside surface portions in contact with one another and ultrasonically sealing the inside surface portions together.

In a still further aspect of the method, the end portions of the elongated member are secured in an abutting relationship in forming the ring. Further, the ring preferably has a circular form and is positioned substantially concentric with the longitudinal axis of the tubular body.

In a further aspect of the method the member is secured to an inside surface of the sidewall by ultrasonic welding. Preferably, the rolled sheet forms overlapping side edges, with the edges being ultrasonically welded to form a side seam within the tubular body.

BRIEF DESCRIPTION OF THE DRAWINGS

For the purpose of illustrating the invention, there is shown in the drawings one or more forms that are presently preferred; it being understood that the invention is not limited to the precise arrangements and instrumentalities shown.

DETAILED DESCRIPTION

Figure 1:
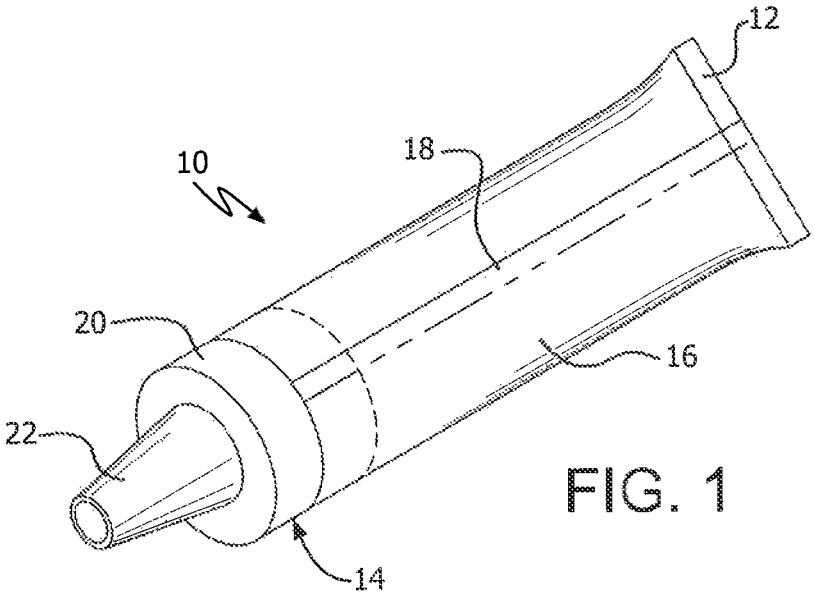
FIG. 1 shows a perspective view of an embodiment of a dispenser as contemplated by the present disclosure.

Referring now to the drawings, where like numerals identify like elements, there is shown in FIG. 1 a dispenser, which is generally referred to by the numeral 10. In FIG. 1, the dispenser 10 is in the form of a tube having a sealed end 12 and a fitment in the form of a dispensing nozzle 14 provided at the opposite end. The tube 10 includes a generally cylindrical sidewall 16 that defines a tube body that surrounds a longitudinal axis and an internal volume. The sidewall 16 includes an inside wall surface and a side seam 18 is provided for sealing the sidewall 16. The tubular body extends longitudinally for a distance greater than a maximum transverse dimension of the interior volume. As shown, the side seam 18 extends in a longitudinal direction substantially aligned with the longitudinal axis of the body.

The nozzle fitment 14 is a separate element from the tube 10. The fitment 14 includes a base portion 20 and a tapered end portion 22. A cap (not shown) may be provided for closing the nozzle 14. The tube 10 retains a quantity of flowable product, typically having a relatively high viscosity. Compressing the tube sidewall 16 causes the flowable product to be discharge from the opening of the nozzle 14. Other forms of fitments and discharge openings may be combined with the tube.

Figure 2:
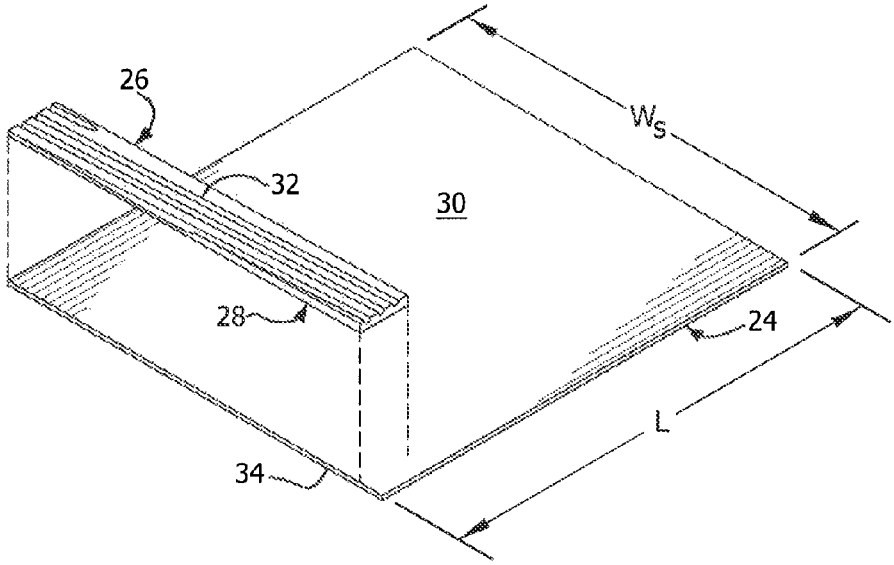
FIG. 2 shows an exploded view of various structures of the dispenser of FIG. 1 during a formation process.

In FIGS. 2-7, there is shown the constituent parts of the dispenser 10 and a method of assembly. In FIG. 2, a sheet 24 is provided having a defined width Ws and as illustrated a defined length L. A fitment attachment member 26 is provided having a first surface 28 for securing the member 26 to the top surface 30 of the sheet 24. A second surface 32 on member 26 includes a retainer pattern. The member 26 is positioned adjacent the front edge 34 of the sheet 24 and extends for a portion of the width Ws of the sheet 24.

Figure 3A:
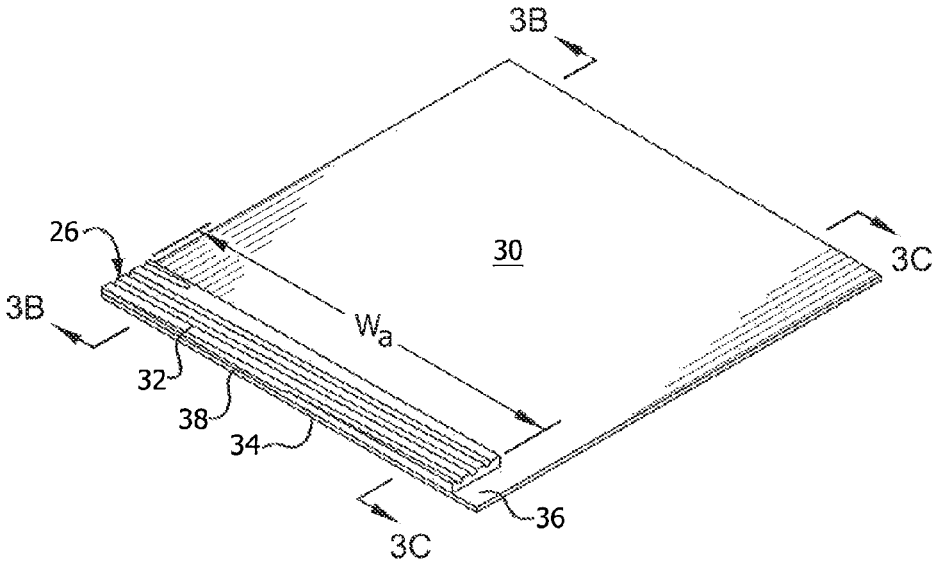
FIG. 3A shows a view of a further step in the formation process of the dispenser.
Figure 3B:
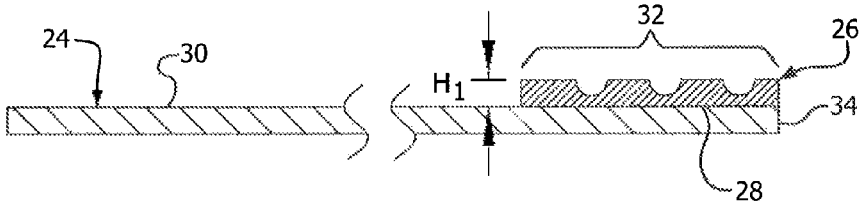
FIG. 3B shows a cross sectional view as taken along line 3B-3B in FIG. 3A.
Figure 3C:
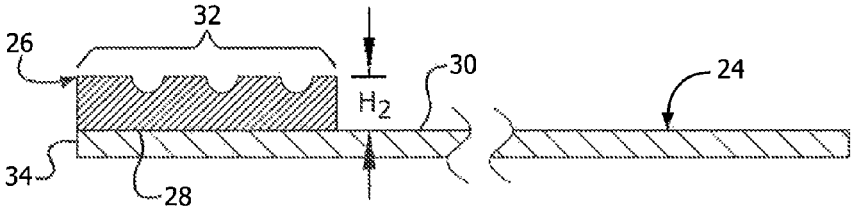
FIG. 3C shows a cross sectional view as taken along line 3C-3C in FIG. 3A FIGS. 4-6 show further steps in a formation process of the dispenser.

In FIG. 3A, the attachment member 26 is shown secured top surface of the sheet 24. Preferably, the first or bottom surface 28 of the member 26 is secured to the top surface 30 of the sheet 24. One side edge 38 of the member 26 is aligned with the front edge 34 of the sheet 24. In the embodiment shown, the width Wa of member 26 is slightly less than the width Ws of the sheet 24. Alignment of the member 26 on the sheet 24 is such that an open edge portion 36 is provided on the front edge 34 of the sheet 24. As shown in FIGS. 3B and 3C, the height is different for the opposing ends of the member 26. In the cross section of FIG. 3B, taken in the direction opposite of the open edge 36, the height or thickness of the element 24 is labeled H1. As a comparison, the height H2 of member 26 in the cross section of FIG. 3C is shown to be relatively greater than height H1.

Figure 4:
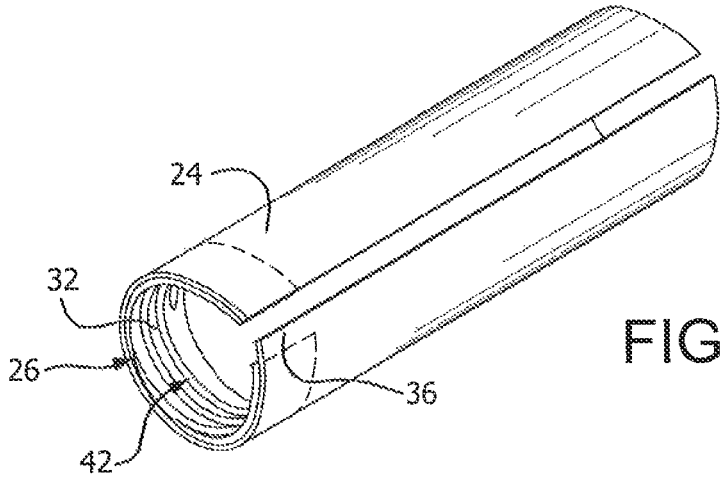
Figure 5:
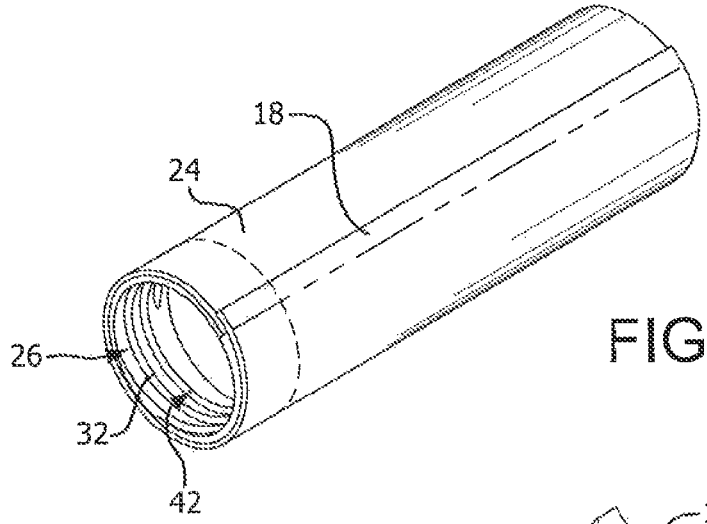
Figure 6:
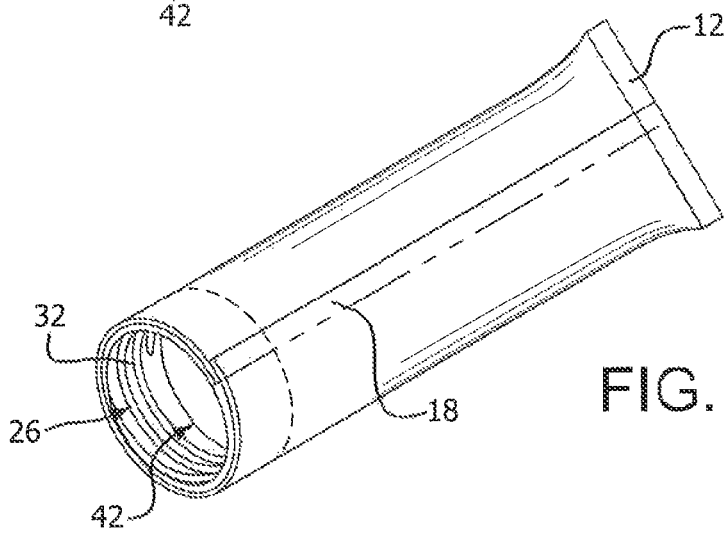

In FIG. 4, the sheet 24 with attached member 26 is rolled to bring the opposing side edges of the adjacent one another. The rolling of the sheet 24 creates the tubular body and also causes element 26 to form an internal ring. The ring as shown has a circular form, substantially concentric with the longitudinal axis. of the body. The member 26 is elongated and is secured to the sheet 24 in a direction transverse to the longitudinal axis of the tubular body. In FIG. 5, the opposing side edges of the sheet 24 overlap one another to form a lap seal 18. The opposing edges of the member 26 are positioned adjacent one another. Preferably the retainer pattern portions at the opposing edges of member 26 align at butted ends of the member 26. Preferably, the variation in thickness (heights H1 and H2) of the ends of member 26 combined with the overlap of the side edges of the sheet 24 to align the top surface portions 32. In FIG. 6, the cylindrical tube is closed at the sealed end 12 by a permanent seal.

Figure 7:
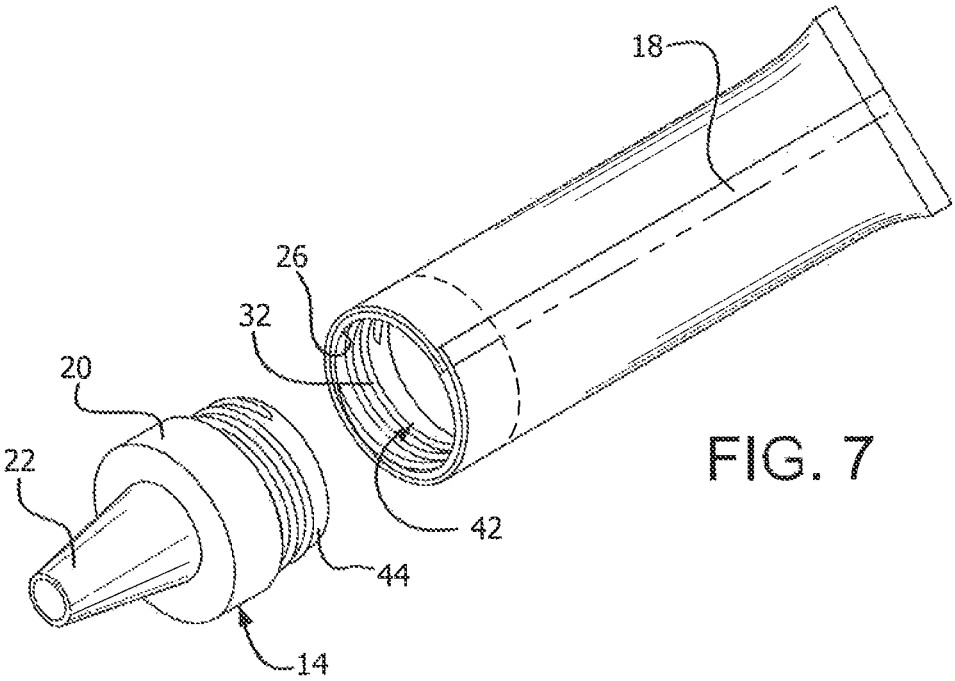
FIG. 7 shows an exploded view of a still further step in the formation process of the dispenser.

In FIG. 7, the nozzle fitment 14 is shown adjacent the open cylindrical end 42 and the ring formed by the member 26. The fitment 14 includes a retainer portion 44 extending from the body 20, opposite the tapered portion 22. A screw thread pattern (as shown) is provided on the retainer portion 44 and matches the retainer pattern 32 of the ring formed by the attachment member 26, such that the fitment 14 may be threaded into and retained by the open end 42 of the tube 10 (as shown in FIG. 1). Prior to securing the fitment 14, the tube 10 may be filled with a flowable or other product. Attachment of the fitment 14 by means of the threads of the ring formed by member 26 seals the flowable product within the dispenser 10.

The sheet 24 is preferably formed from a web of flexible plastic and may be a laminate material. Alternatively, the sheet may be formed as a composite of paper and plastic layers. The web may be provided on a roll, with individual sheets being cut to size from the web roll prior to attachment of member 26 to the top surface 29 of the sheet 24. Alternatively, the web roll may be fed continuously with attachment members 26 periodically secured to the web and the tube formation started prior to separation of the individual sheet portions from the continuous web. The attachment member 26 is also contemplated to be semi-rigid. The member structure and/or formation material should sufficiently flexible to permit rolling along with the sheet 24 (FIG. 4) and the formation of the internal ring structure. The structure and material of member 26 should also be sufficiently rigid so that the ring retains its desired shape and so that a relatively strong retaining surface is provided for engagement of the fitment 14.

The attachment member 26 may be injection molded and is preferably ultrasonically welded to the top surface 30 of the sheet 24. Other means of attachment may also be utilized, including heat sealing, adhesives, etc. Many sealing processes, including an ultrasonic welding process, are more easily conducted on relatively flat surfaces and by applying the seal in relatively straight lines. By fixing the member 26 prior to rolling the sheet 24, the bond between the two elements is thus more easily formed. The separate bonds for the side seal 18 and the end seal 12 may also be formed by ultrasonic welds. The side seal 18 is shown as a lap seal. However, a fin-type seal or a seal of abutting edges may also be utilized.

The ring formed by the attachment element creates a receiving surface for fixing a fitment in the end of the tube. The exposed surface of the attachment member is provided with a linear form of the completed attachment pattern. Attachment patterns other than the threaded pattern shown in the figures may be utilized for securing a fitment to the open end of the tube. The attachment pattern may be continuous or may be staggered. A void may be formed in the pattern at any position along the linear length of the attachment member.

For example, a void may be included at the linear ends of the attachment member, which may eliminate the need for precise alignment of the edges of the member during ring formation.

The ring preferably forms the female surface for receipt of the male extension on the fitment. Further, the attachment pattern may provide for removal of the fitment or may fix the fitment in the tube end. An adhesive or welding process may further be added to secure the fitment to the attachment element and the tube. The tube body is preferably elongated, in that the length of the tube is greater than it maximum diameter (or other transverse dimension).

The tube may have shapes other than the circular form shown in the drawings. The attachment member may include notches for ease of forming the structure into a ring having a desired shape, including a ring that is non-circular. For example, the open end of the tube may be provided with an oval shape. The oval shape may be formed during the rolling process of the sheet or may be imposed into the tube, by the application of heat or the like, during or after assembly. Other shapes such as square, rectangular, triangular, octagon, etc. may also be formed. A suitable retainer pattern may be provided for insertion of the fitment into the female receiving end of the shaped tube. Further, alternative means for sealing the closed end of the tube, including the provision of a second attachment member formed to receive a differently formed fitment or insert.

In the drawings, the opposing second end of the tubular body is shown as being closed by sealing the inside surfaces of the tube together. Other alternatives are possible, including the provision of a second attachment member adjacent the second edge of the sheet. The second member may be similarly formed as the first attachment member or may desirably have a different construction. A second fitment may be provided for securing to the second attachment member. The second fitment will typically include a structure or function different from the dispensing nozzle shown in FIG. 1. An end cap may be provided for closing the opposing second end and sealing the internal volume of the dispenser. One further alternative would include the addition of two end cap fitments, creating a canister structure, with dispensing occurring by the removal of one cap, whether being released from the retainer pattern engagement or my an opening in the cap.

In the drawings and specification, there has been set forth one or more embodiments of the invention and, although specific terms are employed, these terms are used in a generic and descriptive sense only and not for purposes of limitation. The scope of the invention is set forth in the following claims.

What is claimed is:

1. A dispenser for storing and dispensing product, comprising:

a tubular body having an open first end and an opposing second end, the body formed by a sidewall surrounding a longitudinal axis and defining an internal volume, the sidewall having an inside wall surface, and a side seam sealing the wrapped sidewall;

a fitment attachment member formed separately from the body and secured to the inside surface of the sidewall, adjacent the open end of the body, the fitment attachment member having a linear form and having two linear ends, the two linear ends of the fitment attachment member positioned adjacent one another in the form of a ring, the ring secured within the open first end of the tubular body, and a fitment formed separate from the attachment member having a body portion, a discharge opening formed in the body portion, and a fitment retainer pattern formed on the body portion, a corresponding retainer pattern formed on the attachment member, the fitment retainer pattern and the corresponding retainer pattern cooperating with one another for securing the fitment to the open first end of the body.

2. The dispenser as in claim 1, wherein the tubular body extends longitudinally for a distance greater than a maximum transverse dimension of the interior volume.

3. The dispenser as in claim 1, wherein the side seam extends in a longitudinal direction substantially aligned with the longitudinal axis of the sidewall.

4. The dispenser as in claim 1, wherein the ring has a circular form, substantially concentric with the longitudinal axis.

5. The package as in claim 1, wherein the two linear of the fitment attachment member are secured in an abutting relationship.

6. The dispenser as in claim 1, wherein the retainer pattern on the body portion of the fitment is formed as a screw thread.

7. The dispenser as in claim 6, wherein the corresponding retainer pattern on the fitment attachment member is formed as a screw thread, the thread pattern facing radially inward on the formed ring.

8. The dispenser as in claim 1, wherein the fitment attachment member is secured to the inside surface of the sidewall by an ultrasonic weld.

9. The dispenser as in claim 1, wherein the side seam on the sidewall is formed by an ultrasonic weld.

10. The dispenser as in claim 1, wherein the second end of the tubular body is closed by a flattened portion of the sidewall with the inside surfaces adjacent the second end sealed to one another.

11. The dispenser as in claim 10, wherein the seal of the second end is formed by an ultrasonic weld.

12. A dispenser for storing and dispensing product, comprising:

a generally elongated body having an open first end and an opposing second end, the body formed by a sheet formed into a tube shape surrounding a longitudinal axis and defining an internal volume, and having a side seam provided longitudinally sealing the sheet;

a fitment formed separately from the body, the fitment having a fitment body portion, a discharge opening formed in the body portion, and a fitment retainer pattern; and an elongated attachment member having an inside surface and an outside surface the outside surface secured to the sheet transverse to the longitudinal axis of the tubular body and formed into an internal ring position adjacent one end during the formation of the tubular body, the attachment member having a retainer pattern provided on the inside, surface, the retainer pattern formed for cooperating with the fitment retainer pattern to secure the fitment to the open first end of the body.

13. The dispenser as in claim 12, wherein the closed end of the tubular body includes a flattened sidewall with inside surfaces sealed to one another.

14. The dispenser as in claim 13, wherein the surfaces of the flattened sidewall are ultrasonically sealed to one another.

15. The dispenser as in claim 12, wherein end portions of the attachment member are secured in an abutting relationship.

16. The dispenser as in claim 12, wherein the ring has a circular form, substantially concentric with the longitudinal axis.

17. The dispenser as in claim 12, wherein the fitment retainer pattern is formed as an external screw thread.

18. The dispenser as in claim 12, wherein the attachment member is secured to an inside surface of the sidewall by an ultrasonic weld.

19. The dispenser as in claim 12, wherein the side seam is formed by an ultrasonic weld.

20. A method of assembling a dispenser comprising the steps of:

providing a sheet having a first surface, a front edge and a length;

providing an elongated attachment member and positioning the member adjacent the front edge of the sheet, transverse to the length, the attachment member having a retainer pattern formed thereon;

securing the attachment member to the first surface of the sheet with the retainer pattern facing in the same direction as the first surface;

rolling the sheet and member about a longitudinal axis to form a tubular body, the tubular body having an inside surface formed from the first surface of the sheet and having an internal ring formed by the attachment member position adjacent one end of the tubular body, the retainer pattern of the attachment member inwardly facing on the ring;

providing a fitment having an external retainer pattern on one end thereof, the one end of the fitment dimensioned for engagement with the ring and the external retainer pattern of the fitment formed for mating with the inwardly facing retainer pattern formed by the ring; and securing the fitment within the ring by mating engagement of the retainer patterns, the fitment closing the one end of the tubular body.

21. The method of claim 20, wherein the fitment comprises a fitment body portion, a discharge opening formed in the body portion, and a fitment retainer portion formed on the one end of the fitment body portion, the fitment retainer porting having the retainer pattern thereon.

22. The method of claim 20, further comprising the step of closing an end of the tubular body, opposite of the one end of the tubular body having the ring thereon.

23. The method of claim 22, wherein the closing of the opposite end of the tubular body comprises the steps of flattening the sidewall of the tubular body with inside surface portions in contact with one another and ultrasonically sealing the inside surface portions to one another.

24. The method of claim 20, wherein end portions of the attachment member are secured in an abutting relationship in forming the ring.

25. The method of claim 20, wherein the ring has a circular form positioned substantially concentric with the longitudinal axis.

26. The method of claim 20, wherein the attachment member is secured to an inside surface of the sidewall by ultrasonic welding.

27. The method of claim 20, wherein the rolled sheet forms overlapping side edges and further comprising the step of ultrasonically welding the overlapping edges to form a side seam within the tubular body.

* * * * *